US008213671B2

(12) United States Patent
Matsuda et al.

(10) Patent No.: US 8,213,671 B2
(45) Date of Patent: Jul. 3, 2012

(54) SPEAKER

(75) Inventors: Kyoichi Matsuda, Yamagata (JP); Toshihiro Hikichi, Yamagata (JP); Daisuke Itoh, Yamagata (JP); Teruaki Kaiya, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 457 days.

(21) Appl. No.: 12/447,240

(22) PCT Filed: Nov. 1, 2006

(86) PCT No.: PCT/JP2006/321882

§ 371 (c)(1),
(2), (4) Date: Jun. 24, 2009

(87) PCT Pub. No.: WO2008/053551

PCT Pub. Date: May 8, 2008

(65) Prior Publication Data

US 2010/0002901 A1 Jan. 7, 2010

(51) Int. Cl.
*H04R 1/00* (2006.01)
*H04R 7/00* (2006.01)

(52) U.S. Cl. ..... 381/423; 181/157

(58) Field of Classification Search ..... 381/423; 181/148, 157, 163, 173
See application file for complete search history.

(56) References Cited

U.S. PATENT DOCUMENTS 6,236,733 B1 * 5/2001 Kato et al. ..... 381/423
6,237,716 B1 * 5/2001 Peng ..... 181/173

FOREIGN PATENT DOCUMENTS

| | | | |
|---|---|---|---|
| JP | 58-056600 | A | 4/1983 |
| JP | 58-127793 | U | 8/1983 |
| JP | 60-177591 | U | 11/1985 |
| JP | 63-038497 | U | 3/1988 |
| JP | 06-007394 | U | 1/1994 |
| JP | 2000-308180 | A | 11/2000 |
| JP | 11-018196 | B2 | 5/2003 |
| JP | 2006-222989 | A | 8/2006 |

OTHER PUBLICATIONS

International Search Report from Intl App No. PCT/JP2006/321882 dated on Nov. 28, 2006.

* cited by examiner

*Primary Examiner* — Brian Ensey
(74) *Attorney, Agent, or Firm* — Arent Fox LLP

(57) ABSTRACT

A speaker having improved sound quality by reducing a phase difference and also having an outstanding outward appearance is provided. In a speaker comprising a vibrating element 10, a drive unit 20 for vibrating the vibrating element 10, and a frame 30 supporting the vibrating element 10 and the drive unit 20, the vibrating element 10 comprises a front face region 10A which forms a continuously curved face having a convex-shaped cross-sectional portion $T_1$ formed in its central portion and a concave-shaped cross-sectional portion $T_2$ formed around the portion $T_1$, and a connecting region 10B located on the rear side of the front face region 10A and connected to the drive unit 20.

19 Claims, 8 Drawing Sheets

PRIOR ART

SPEAKER

CROSS-REFERENCE TO RELATED APPLICATION

This application is a National Stage entry of International Application No. PCT/JP2006/321882, filed Nov. 1, 2006, the entire specification claims and drawings of which are incorporated herewith by reference.

TECHNICAL FIELD

The present invention relates to speakers.

BACKGROUND ART

A speaker produces vibrations in a vibrating element including a diaphragm by means of an audio current for sound generation. There are various forms of diaphragms in accordance with types of speakers, of which a cone shaped diaphragm is most often used for a direct-radiating type speaker. The drive unit for vibrating the vibrating element comprises a voice coil to which the audio current is applied, a voice coil bobbin having an outer periphery around which the voice coil is wound, and a magnetic circuit in which a magnetic gap is provided for allowing an electromagnetic force to act on the voice coil. The voice coil bobbin is connected to the inner periphery of the vibrating element supported at its outer periphery by the frame, so that the vibrations caused by the action of the electromagnetic force on the voice coil are transmitted through the voice coil bobbin to the vibrating element.

FIG. 1 is an illustration (sectional view) showing the related art of a cone-type speaker described in Patent Document 1 as described below. In this related art, the outmost periphery of the diaphragm J1 is connected through an edge J2 to a frame J3. The innermost diameter portion of the diaphragm J1 is connected to a voice coil bobbin J4, and the outer periphery of the voice coil bobbin J4 is held by a damper J5 secured to the frame J3 so as to center the voice coil bobbin J4. In addition, a center cap J6 is attached to the surface of the diaphragm J1. A magnetic circuit J7 is disposed in the lower portion of the frame J3. A voice coil J8, which is wound on the lower portion of the voice coil bobbin J4, is disposed in a magnetic gap J7A in the magnetic circuit J7. Then, in this structure, the outer circumferential rim of the center cap J6 is fitted into a stepped stage J1A formed on the diaphragm J1.

Patent Document 1: Japanese Patent No. 3433342.

DISCLOSURE OF THE INVENTION

Problems to be Solved by the Invention

In such a cone-type speaker, the diaphragm, the edge and the center cap are integrated to form a single vibrating element. It goes without saying that the structure, shape and materials of the vibrating element are critical factors in deciding the acoustic characteristics of the speaker such as reproduction frequency characteristics and the like.

In the cone-shaped diaphragm such as in the related art, a depth is created between the central portion of the diaphragm and the peripheral portion of the diaphragm. For this reason, when the diaphragm is increased in diameter, a phase difference is created between the sound wave emerging from the central portion of the diaphragm and the sound wave emerging from the peripheral portion, which in turn causes interference, possibly resulting in the unwanted undulation or attenuation of sound which may lead to a reduction in sound quality.

For solving such a problem associated with the phase difference, a flat diaphragm with a flat surface of the diaphragm is effective. However, in the case of the flat diaphragm, considering the connection with the drive unit, uniform vibrations of the front face of the flat diaphragm are made difficult, giving rise to divided vibrations in which the diaphragm locally creates a variety of vibrations. As a result, such problems arise as the case that the frequency characteristics change for the worse.

In addition, in the case of a diaphragm with a surface with which the center cap is mounted integrally as described in the related art, if the boundary of the center cap and the diaphragm bends discontinuously, when the diaphragm is mounted in a subwoofer or the like which greatly vibrates it, the stress concentration acts on the bending portions. In particular, if the bending portions are formed concentrically with the connection area to the voice coil bobbin, a problem arising is that the strength is apt to be decreased by the stress concentration. In addition, dust and the like are easily accumulated in the bending portions, which cause the problem of worsened vibration characteristics in the diaphragm as well as the problem of an inferior outward appearance.

To solve such problems is one example of the objects of the present invention. Specifically, it is an object of the present invention to provide a speaker which achieves a reduction in the phase difference of the sound emitted to improve the sound quality, prevents divided vibrations in a vibrating element to obtain favorable frequency characteristics, has sufficient strength to withstand large-amplitude vibrations, and is equipped with a vibrating element having satisfactory vibration characteristics and an outstanding outward appearance, and the like.

Means for Solving the Problems

To attain such an object, a speaker according to the present invention is at least equipped with a vibrating element, a drive unit for vibrating the vibrating element, and a frame supporting the vibrating element and the drive unit. The vibrating element comprises a front face region which forms a continuously curved face having a convex-shaped cross-sectional portion formed in its central portion and a concave-shaped cross-sectional portion formed around the convex-shaped cross-sectional portion, and a connecting region located on the rear side of the front face region and connected to the drive unit. Further, the drive unit comprises a voice coil to which an audio current is applied, a voice coil bobbin having an outer periphery around which the voice coil is wound, and a magnetic circuit with a magnetic gap formed therein for allowing an electromagnetic force to act on the voice coil, and the rear end of the connecting region is connected to the outer periphery of the voice coil bobbin located coaxially with the center of the vibrating element.

BRIEF DESCRIPTION OF THE DRAWINGS

These and other objects and advantages of the present invention will become clear from the following description with reference to the accompanying drawings, wherein.

THE BEST MODE FOR CARRYING OUT THE INVENTION

Figure 1:
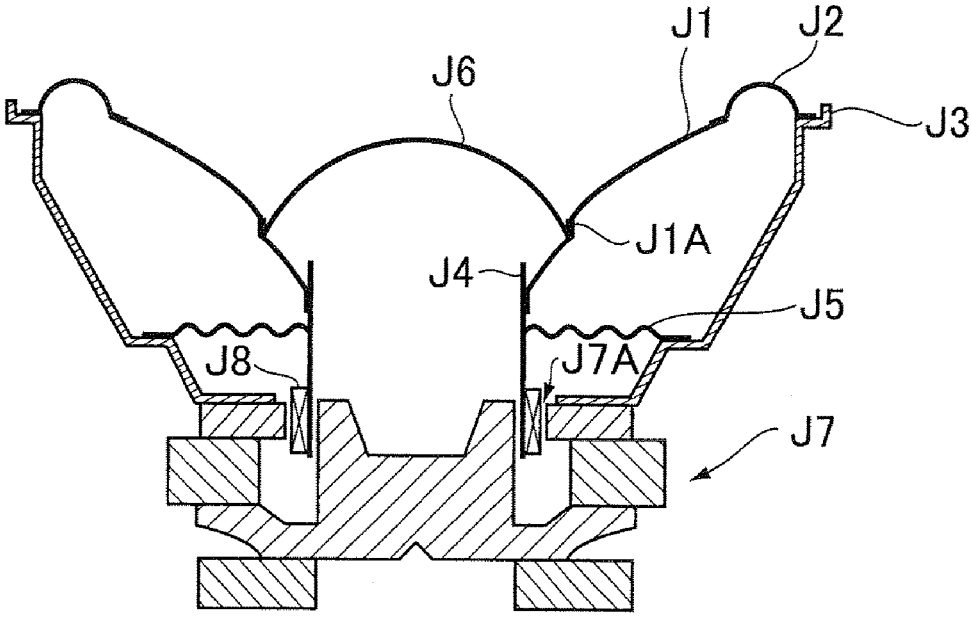
FIG. 1 is an illustration of the related art.
Figure 2:
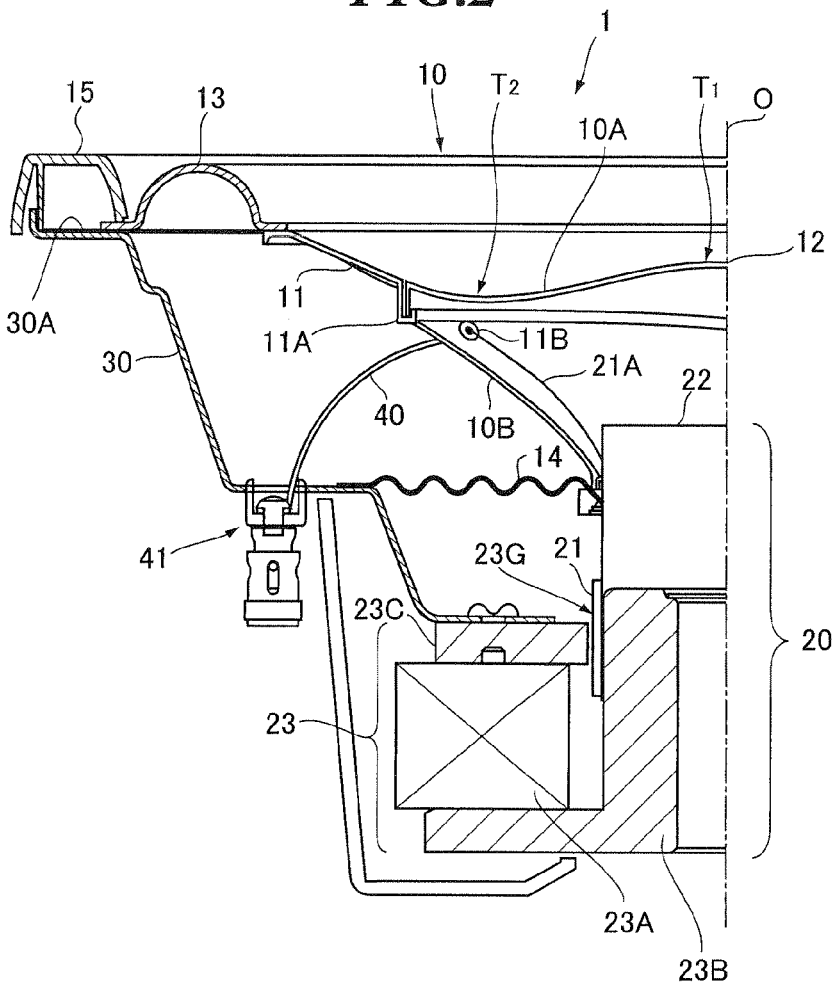
FIG. 2 is an illustration (a half sectional view with respect to the centerline) of a speaker according to an embodiment of the present invention.

Next, embodiments of the present invention will be described with reference to the drawings. FIG. 2 is an illustration (half sectional view with respect to the centerline 0) showing the structure of a speaker according to an embodiment of the present invention. The speaker 1 according to the embodiment of the present invention comprises a vibrating element 10, a drive unit 20 creating vibrations in the vibrating element 10, and a frame 30 supporting the vibrating element 10 and the drive unit 20.

In the illustrated embodiment, the vibrating element 10 is provided with a diaphragm 11, a center cap 12, an edge member 13, and a damper member 14, but need not to be so limited, for example, the diaphragm 11 and the center cap 12 may be molded in one piece to form a single diaphragm. The vibrating element 10 comprises a front face region 10A and a connecting region 10B. The front face region 10A forms a continuously curved face having a central convex-shaped cross-sectional portion $T_1$ and a periphery concave-shaped cross-sectional portion $T_2$ around the portion $T_1$. The connecting region 10B is located behind the front face region 10A and forms connection between the vibrating element 10 and the drive unit 20.

The drive unit 20 comprises a voice coil 21 to which an audio current is applied, a voice coil bobbin 22 having an outer periphery around which the voice coil 21 is wound, and a magnetic circuit 23 with a magnetic gap 23G formed therein for allowing an electromagnetic force to act on the voice coil 21. The configuration of the magnetic circuit 23 is not specially limited. The example shown illustrates a magnetic circuit with a ring shaped magnet in which a magnet 23A is disposed outside the magnetic gap 23G. The magnet 23A is held between the bottom of a yoke 23B made of magnetic materials and a plate 23C, and the magnetic gap 23G is formed between the inner peripheral face of the ring-shaped plate 23C and the outer peripheral face of the center pole of the yoke 23B.

A feature of the speaker 1 according to the embodiment of the present invention is that the vibrating element 10 comprises the front face region 10A forming the continuously curved face having a central convex-shaped cross-sectional portion $T_1$ and a peripheral concave-shaped cross-sectional portion $T_2$ around the portion $T_1$ and the connecting region 10B located behind the front face region 10A and connected to the drive unit 20, in which the rear end of the connecting region 10B is connected to the outer periphery of the voice coil bobbin 22 located coaxially with the center of the vibrating element 10.

This means that, because the front face region 10A has a convex-shaped cross-sectional portion $T_1$ and a concave-shaped cross-sectional portion $T_2$, the depth of the vibrating surface is reduced, thus making it possible to reduce the phase difference between a sound wave emerging from the convex-shaped cross-sectional portion $T_1$ and a sound wave emerging from the concave-shaped cross-sectional portion $T_2$. In this case, a decrease in the difference between the depth of the convex-shaped cross-sectional portion $T_1$ and the depth of the concave-shaped cross-sectional portion $T_2$ makes it possible to eliminate the aforementioned problem associated with the phase difference to the maximum degree.

Also, the front face region 10A forms a continuously curved face that has a central convex-shaped cross-sectional portion $T_1$ and a peripheral concave-shaped cross-sectional portion $T_2$ around the portion $T_1$. In addition, the rear end of the connecting region 10B is connected to the outer periphery of the voice coil bobbin 22 which is located coaxially with the center of the vibrating element 10. As a result, the driving force transmitted from the voice coil bobbin 22 through the connecting region 10B to the front face region 10A acts uniformly on the front face region 10A forming the continuously curved face which is axially symmetrical about the center. Accordingly, because of the continuously curved face, a vibrating element 10 is formed in such a way that it does not create divided vibrations as in the cases of the cone type and the dome type.

In addition, the front face region 10A is a continuously curved face, so that it does not have discontinuously bending portions as are found in the related art. Accordingly, even when a large-amplitude output is produced, stress concentration does not occur in the front face region 10A of the vibrating element 10, so that a vibrating element 10 with a high strength can be provided. Also, there is no bending portion on the surface, so that dust and the like are not easily accumulated, thus allowing the diaphragm to maintain satisfactory vibration characteristics and providing a vibrating element 10 with a good outward appearance.

In the illustrated embodiment, the vibrating element 10 comprises a diaphragm 11 forming the outer peripheral portion of the front face region 10A and the connecting region 10B, a center cap 12 forming the central portion of the front face region 10A, an edge member 13 connecting the outer periphery rim of the diaphragm 11 to the frame 30, and a damper member 14 through which the voice coil bobbin 22 is supported by the frame 30.

According to the embodiment, the connecting region 10B is concealed behind the center cap 12, and the continuously curved face of the front face region 10A makes the existence of the center cap 12 indiscernible, so that the vibrating element 10 with an outstanding outward appearance can be provided and the center cap 12 can prevent dust and the like from entering the drive unit 20, thus making it possible to favorably maintain the operation of the drive unit 20.

In addition, in the speaker 1 according to the embodiment of the present invention the diaphragm 11 comprises a supporter 11A having a stepped stage provided on the boundary position between the outer peripheral portion of the front face region 10A and the connecting region 10B and extending in the rear direction of the speaker. The supporter 11A supports the outer peripheral rim of the center cap 12 such that the outer peripheral portion of the front face region 10A within the diaphragm 11 and the front face of the center cap 12 form a seamlessly adjoined face.

This means that the diaphragm 11 and the center cap 12 can be bonded together at the point of the supporter 11A located in the rear direction from the front face region 10A, so that an adhesive or the like is not extruded to the surface of the front face region 10A, resulting in a further improved outward appearance of the front face region 10A. In addition, the positioning process for forming the front face region 10A of the continuously curved face can be produced merely by fitting the outer peripheral rim of the center cap 12 into the supporter 11A, thus making the assembling process simple and precise.

The speaker 1 according to the embodiment of the present invention shown in FIG. 2 is suitable for, in particular, a low-frequency reproduction speaker such as a subwoofer. In this case, the vibrating element 10 may comprise a diaphragm 11 resin-molded of a thermoplastic resin such as polypropylene, a center cap 12 resin-molded of the similar material as that of the diaphragm 11, an edge member 13 formed of elastic materials such as polyurethane foam or rubber, and a damper member 14 formed of textile materials or the like.

The inner peripheral rim of the diaphragm 11 corresponds to the rear end of the connecting region 10B, which is connected to the outer peripheral face of the voice coil bobbin 22. The outer peripheral rim of the diaphragm 11 is connected to the inner peripheral rim of the edge member 13. In turn, the outer peripheral rim of the edge member 13 is attached to a vibrating-element supporter 30A of the frame 30 and secured by a fixing frame 15 placed above the vibrating-element supporter 30A.

Figure 3:
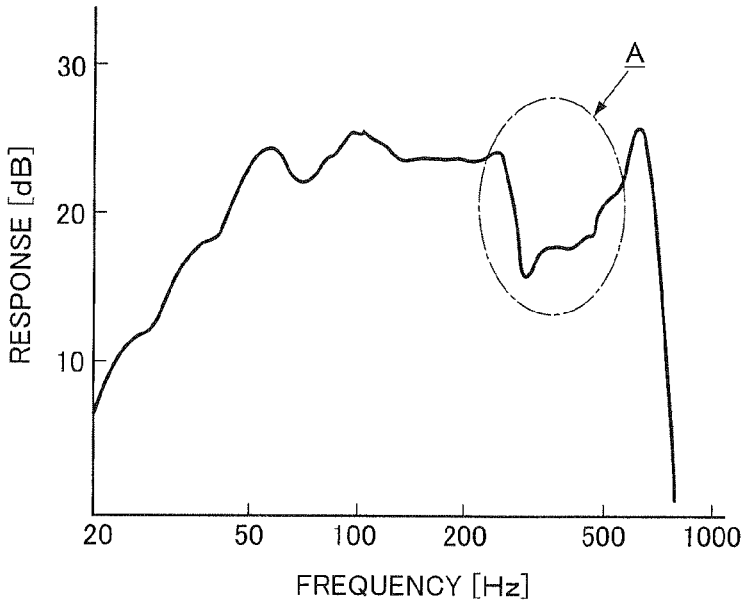
FIG. 3 is an illustration showing the frequency characteristics of the speaker according to the embodiment of the present invention.

FIG. 3 is an illustration showing the frequency characteristics in such an embodiment, which shows the sound-pressure frequency characteristics in an example of specific dimensions. As seen from the graph, the frequency characteristics exhibited have a cut-off band lying in a high-frequency range close to low frequencies as indicated by "A". Such a cut-off band frequency-characteristic occurs in an embodiment equipped with the structure of the aforementioned front face region 10A, and high frequencies can be effectively cut off. As a result, the embodiment has characteristics suitable for a low-frequency reproduction speaker such as a subwoofer.

In the embodiment shown in FIG. 2, the voice coil lead wire 21A of the voice coil 21 is run forward along the connecting region 10B, then run to the outside through a hole 11B drilled in a front-side portion of the connecting region 10B, and then connected to a flexible wire 40. In turn, an end of the flexible wire 40 is connected to a terminal 41 provided on the frame 30. This means that because a longer distance can be provided from the connection with the flexible wire 40 to the terminal 41, any inconvenience does not occur such that the flexible wire 40 comes into contact with the frame 30 even when the amplitude motion of the voice coil bobbin 22 is increased. In addition, because the end of the flexible wire 40 is run out from the hole 11B which is drilled a rearward portion of the outer peripheral rim of the diaphragm 11, abnormal sounds produced by contact of the flexible wire 40 with the diaphragm 11 can be prevented.

Figure 4:
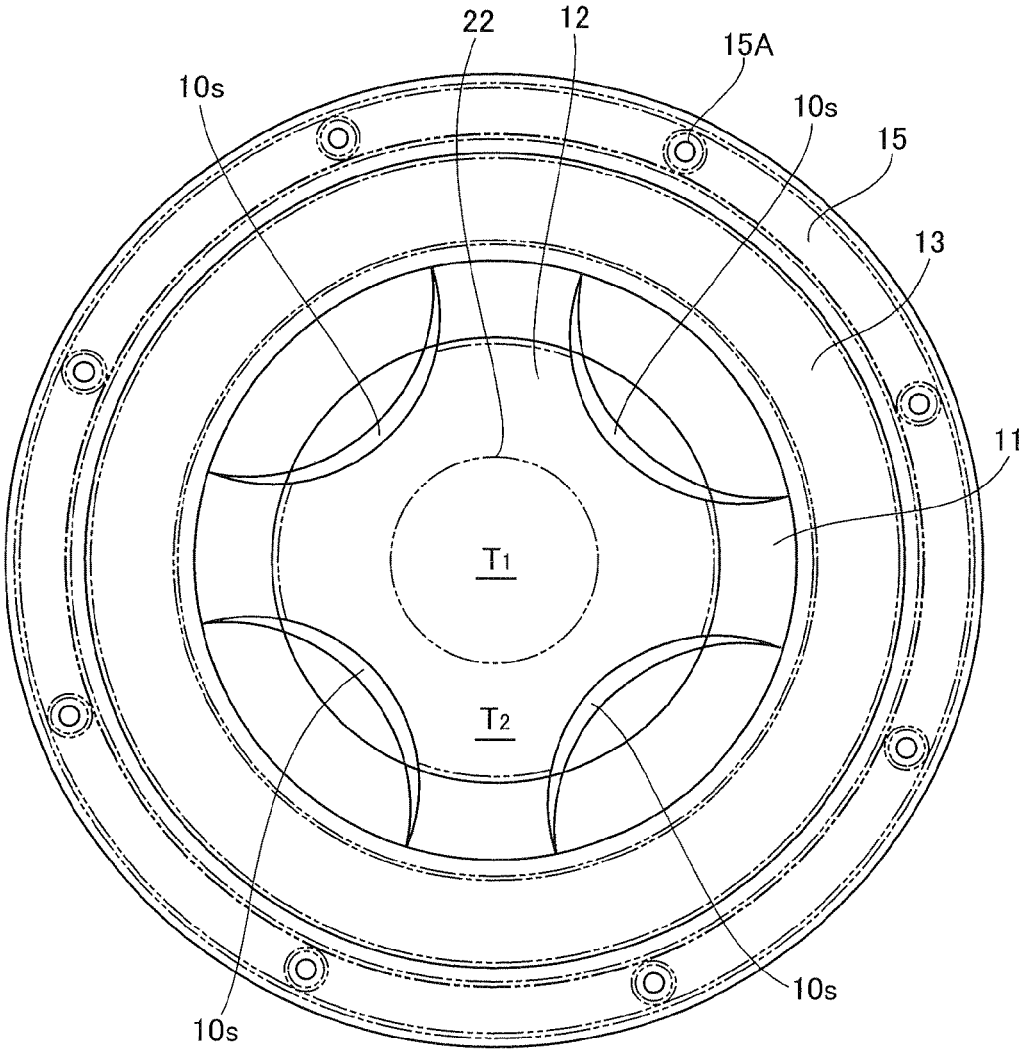
FIG. 4 is an illustration (top view) of a speaker according to an embodiment of the present invention.

FIG. 4 is a top view of the speaker 1, which is an illustration of the front face region 10A when viewed from the front. The center cap 12 is located in a central portion. The outer peripheral portion of the diaphragm 11 is located around the center cap 12, and the inner peripheral rim of the edge member 13 is connected to the outer peripheral rim of the diaphragm 11. The outer peripheral rim of the edge member 13 is secured to the aforementioned vibrating-element supporter 30A by the fixing frame 15 (15A denotes a fixture).

In the embodiment, the surface of the center cap 12 is formed of the convex-shaped cross-sectional portion $T_1$ and the concave-shaped cross-sectional portion $T_2$. This design leads to a solution of the aforementioned problem associated with the phase difference between sound waves and results in the reinforcement of the center cap 12 itself. When the vibrating element 10 is strongly vibrated to reproduce a sound at high-volume levels, high air resistance acts on the center cap 12, thus causing deformation such as a dent. In turn, this deformation causes difficulty in reproducing in-phase sound waves, leading to a reduction in sound quality. In some cases, the center cap 12 itself may vibrate so as to produce abnormal sounds. To inhibit the foregoing, the convex-shaped cross-sectional portion $T_1$ and the concave-shaped cross-sectional portion $T_2$ are designed on the surface of the center cap 12 itself for reinforcement of the center cap 12. This makes it possible to inhibit the deformation and the vibration of the center cap 12, resulting in an improvement in sound quality and inhabitation of abnormal sounds.

In the example shown in the drawings, aesthetic surface shaped portions 10*s* are provided on the surface of the front face region 10A. The surface shaped portion 10*s* is formed in a shape extending continuously from the center cap 12 to the diaphragm 11 in order to conceal the boundary between the center cap 12 and the diaphragm 11, thus improving the design properties. The surface shaped portion 10*s* desirably has a reinforcing function of countering external forces during the vibrations concentrically acting.

Figure 5:
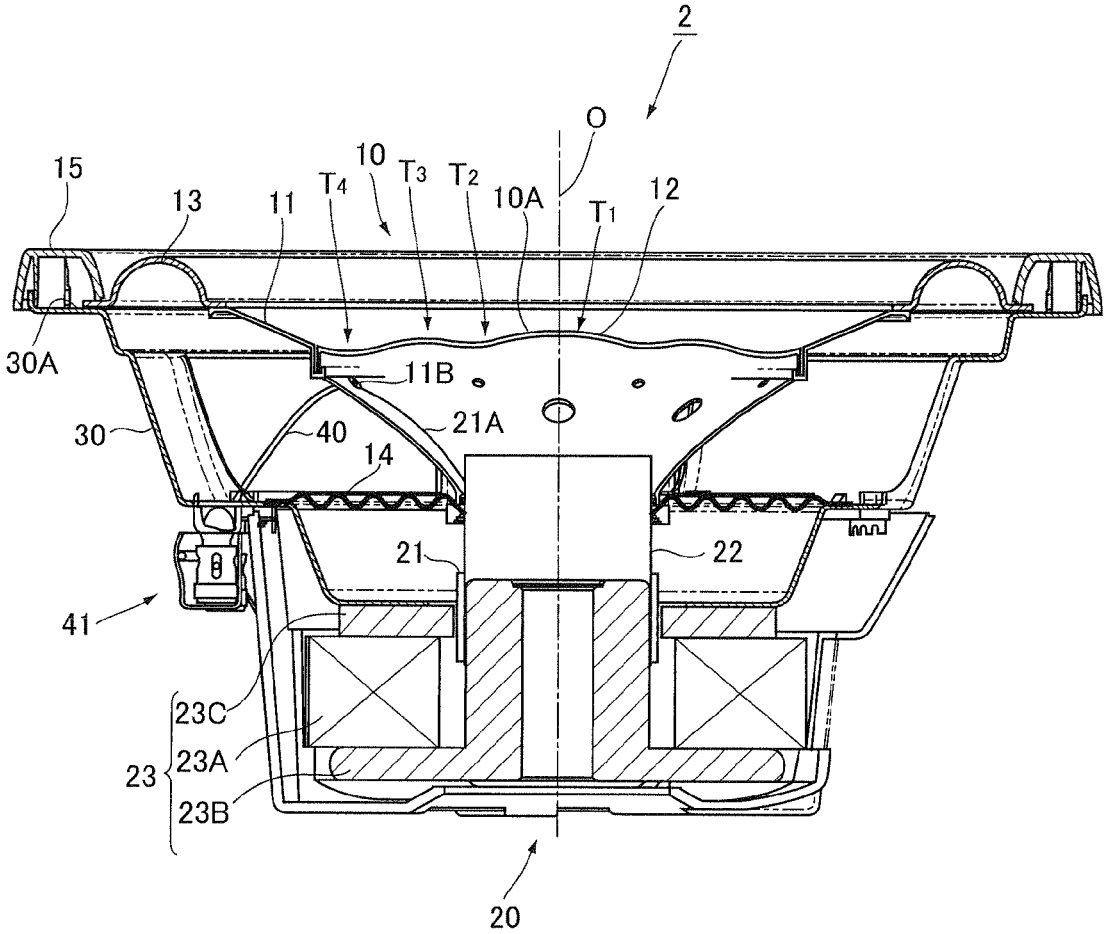
FIG. 5 is an illustration (sectional view) of a speaker according to an embodiment of the present invention.

FIG. 5 is an illustration (sectional view) describing a speaker 2 according to another embodiment of the present invention. The same components as those in the aforementioned embodiment are designated by the same reference numerals and the repeated description is omitted. The speaker 2 according to the embodiment has a plurality of convexes-and-concaves concentrically formed on the surface of the front face region 10A. In the example shown in FIG. 5, on the surface of the center cap 12 a convex-shaped cross-sectional portion $T_1$ is formed in the center as described earlier, a concave-shaped cross-sectional portion $T_2$ along the outer periphery of the convex-shaped cross-sectional portion $T_1$, a convex-shaped cross-sectional portion $T_3$ along the outer periphery of the concave-shaped cross-sectional portion $T_1$, and a concave-shaped cross-sectional portion $T_4$ along the outer periphery of the convex-shaped cross-sectional portion $T_3$.

In this speaker 2, the plurality of the concaves and convexes formed in the front face region 10A makes it possible to allow the sound waves emerging from the front surface to be approximately in phase with one another, thus more reducing the phase difference between the sound waves emerging. In addition, in a speaker with a center cap 12 having a plurality of concaves and convexes formed thereon, the strength of the center cap can be more increased.

Figure 6:
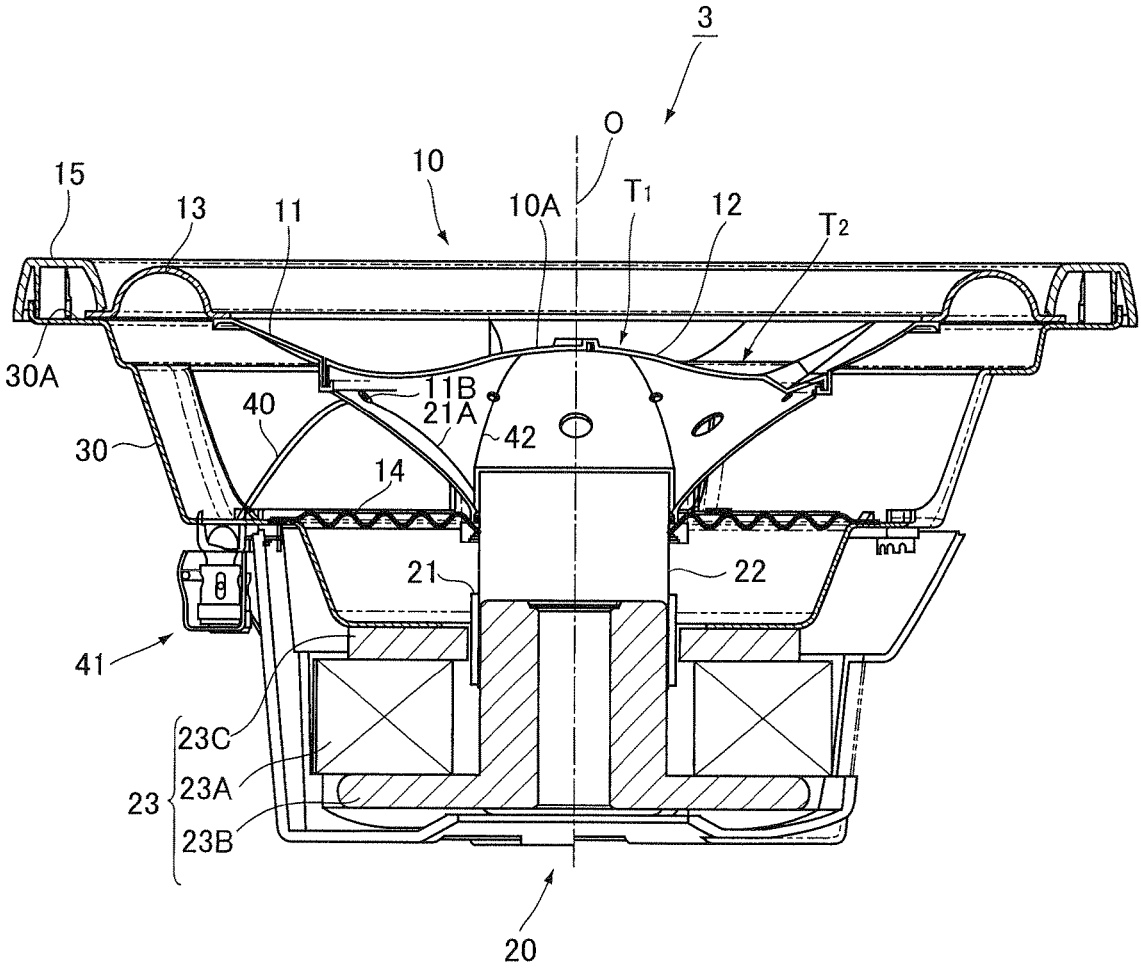
FIG. 6 is an illustration (sectional view) of a speaker according to an embodiment of the present invention.

FIG. 6 is an illustration (sectional view) describing a speaker 3 according to another embodiment of the present invention. The same components as those in the aforementioned embodiment are designated by the same reference numerals and the repeated description is omitted. The speaker 3 according to the embodiment comprises an auxiliary cap 42 supporting the center cap 12 (and is identical with the speaker 1 except for the auxiliary cap 42).

The auxiliary cap 42 is disposed such that it supports the center cap 12. When the vibrating element 10 is strongly vibrated to reproduce a sound at high-volume levels, high air resistance acts on the center cap 12, thus causing deformation such as a dent. This deformation causes difficulty in reproducing in-phase sound waves, leading to a reduction in sound quality. In some cases, the center cap 12 itself may vibrate so as to produce abnormal sounds. To inhibit the foregoing, the auxiliary cap 42 is placed between the voice coil bobbin 22 and the center cap 12 so as to support the center cap 12, so that the vibrating element including the center cap 12 can be increased in strength. This makes it possible to inhibit the deformation and the vibration of the center cap 12, resulting in an improvement in sound quality and inhabitation of abnormal sounds.

Figure 7:
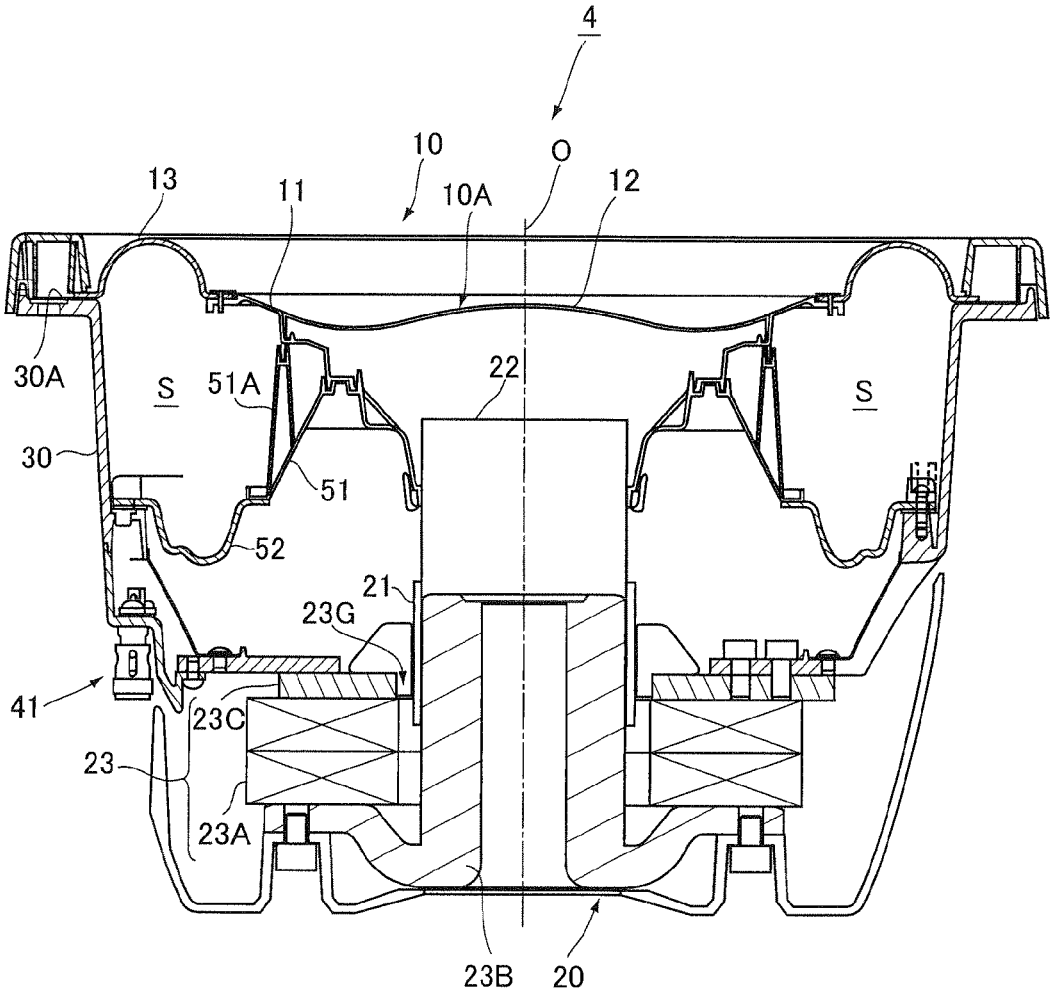
FIG. 7 is an illustration (sectional view) of a speaker according to an embodiment of the present invention.

FIG. 7 is an illustration (sectional view) showing a speaker 4 according to another embodiment of the present invention. The speaker 4 shown in FIG. 7 comprises a vibrating element 10, a drive unit 20 for vibrating the vibrating element 10, and a frame 30 for supporting the vibrating element 10 and the drive unit 20 as in the case of the aforementioned embodiment. In the following, the same structural components as those in the aforementioned embodiment are designated by the same reference numerals and the repeated description is omitted.

A feature of the speaker 4 is the vibrating element 10. The vibrating element 10 includes a drive cone 51 and a second edge member 52. The inner peripheral portion of the drive cone 51 is coupled to the outer peripheral face of the voice coil bobbin 22. Also, the outer peripheral portion of the second edge member 52 is coupled to the inner side of the frame 30 to form a hermetic space S enclosed with the edge member 13, diaphragm 11, drive cone 51, second edge member 52 and the frame 30. In addition, the effective vibration area of the diaphragm 11 is greater than that of the drive cone 51.

The drive cone 51 is a resin-molded member as in the case of the diaphragm 11. A rib 51A, which serves as a column for the hermetic space S, is provided between the drive cone 51 and the diaphragm 11. The second edge member 52 is formed of an elastic material of the same quality as that used for the edge member 13.

This means that, because the voice coil bobbin 22 is held to the frame by means of air-damper structure created by the hermetic space S, the damper function will not change for the worse even when the vibrations are strong. Accordingly, high durability can be maintained even when the speaker 4 is a high power speaker, thus making it possible to provide structure suitable for a low-frequency reproduction speaker such as a subwoofer in addition to the aforementioned frequency characteristics and the like.

Figure 8:
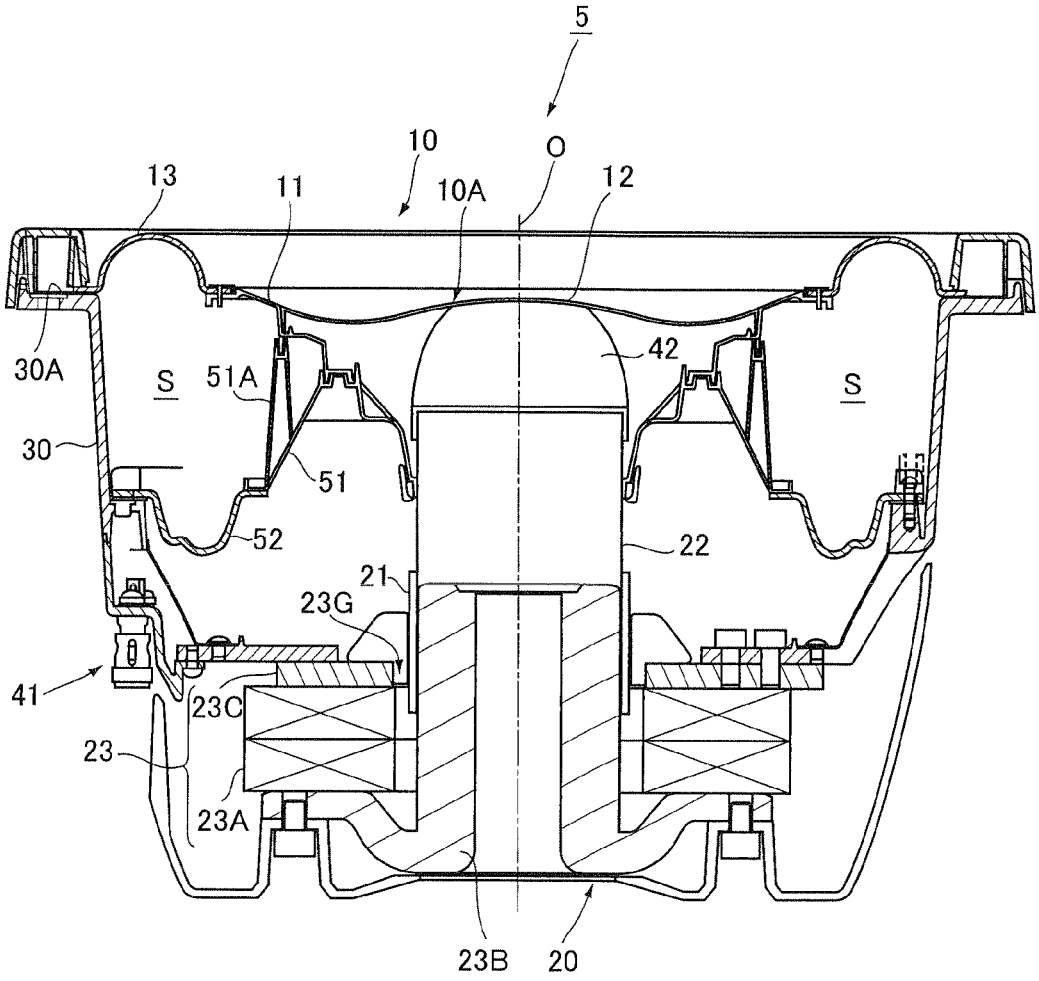
FIG. 8 is an illustration (sectional view) of a speaker according to an embodiment of the present invention.

FIG. 8 is an illustration (sectional view) showing a speaker 5 according to another embodiment of the present invention. The speaker 5 shown in FIG. 8 is identical with the forgoing speaker 4 except that the speaker 5 comprises an auxiliary cap 42 placed to support the center cap 12. In the following, the same structural components as those in the aforementioned embodiment are designated by the same reference numerals and the repeated description is omitted.

In the example shown in FIG. 8, the auxiliary cap 42 is mounted in such a manner as to be coupled to the center cap 12 for supporting the center cap 12. However, for example, the bottom of the auxiliary cap 42 may be supported by the diaphragm 11 (not shown), and the form of the auxiliary cap 42 is not specially limited as long as the strength of the vibrating element 10 can be increased.

Figure 9:
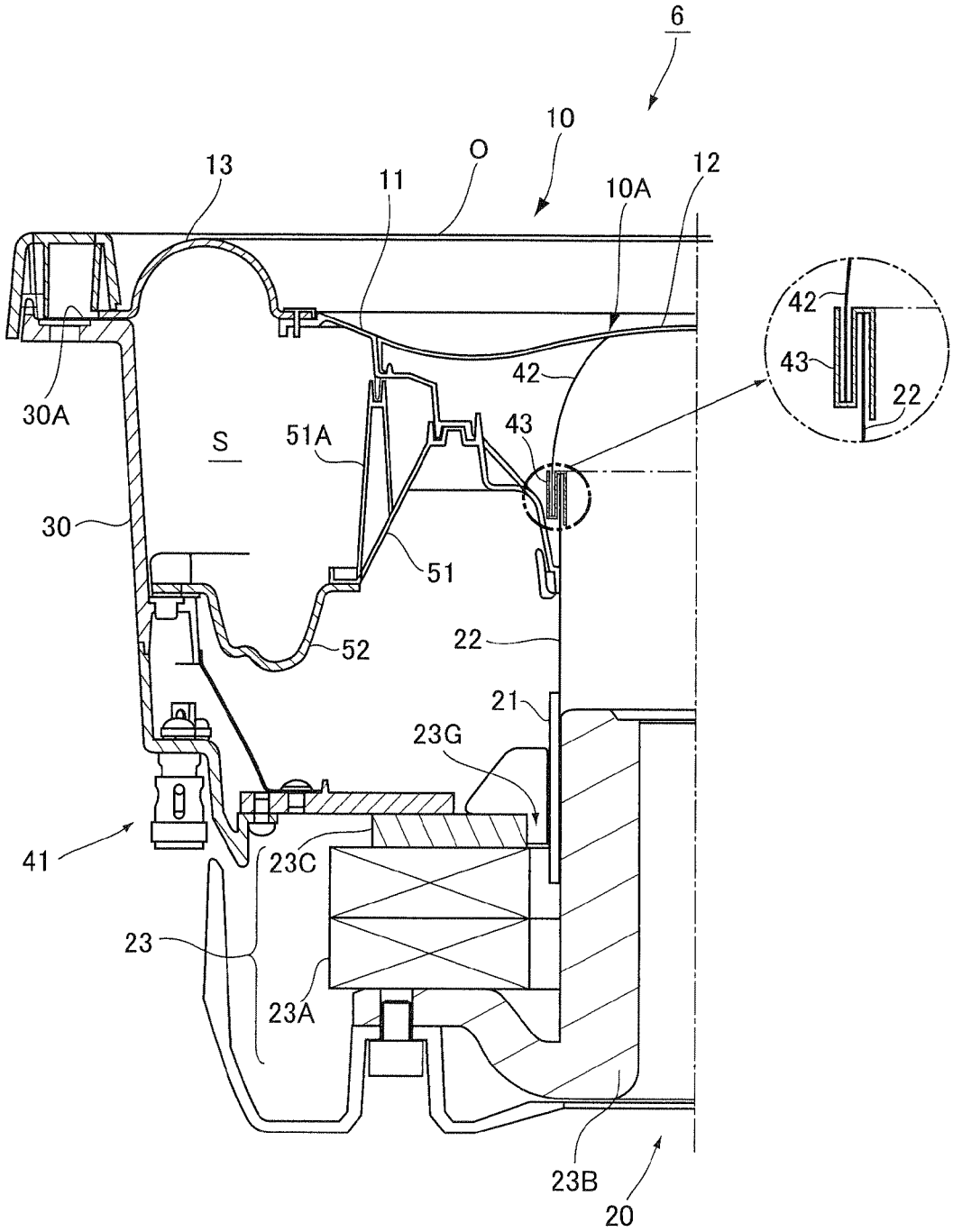
FIG. 9 is an illustration (sectional view) of a speaker according to an embodiment of the present invention.

FIG. 9 is an illustration (sectional view) showing a speaker 6 according to another embodiment of the present invention. In this embodiment, for more enhancing the strength of the vibrating element 10, the drive cone 51 and the voice coil bobbin 22 may be connected to each other through a coupling member 43. The coupling member 43 has an inner peripheral portion formed in a roughly inverted U shape so as to be fixed to the voice coil bobbin 22. In the outer peripheral portion of the coupling member 43 a roughly U-shaped receiving portion is formed to extend from the inner peripheral portion of the coupling member 43 and extend along the outer periphery of the voice coil bobbin 22 such that the auxiliary cap 42 mounted on the coupling member 43 is secured to the voice coil bobbin 22. The shape of the inner peripheral portion of the coupling member 43 is not specially limited as long as the coupling member 43 can be secured to the voice coil bobbin 22. For example, the inner peripheral portion of the coupling member 43 may be formed in an inverted V shape or in a C shape. Also, the shape of the outer peripheral portion of the coupling member 43 is not specially limited, and may be, for example, a V shape or in an inverted C shape. As the method of rigidly fixing the coupling member 43 to the voice coil bobbin 22, the drive cone 51, or the auxiliary cap 42, well-known fixing means, such as the use of an adhesive or a mechanical joint using screws or the like, can be used.

The auxiliary cap 42 is disposed such that it supports the center cap 12 as described above. When the vibrating element 10 is strongly vibrated to reproduce a sound at high-volume levels, high air resistance acts on the center cap 12, thus causing deformation such as a dent. This deformation causes difficulty in reproducing in-phase sound waves, leading to a reduction in sound quality. In some cases, the center cap 12 itself may vibrate so as to produce abnormal sounds. To inhibit the foregoing, the auxiliary cap 42 is placed between the voice coil bobbin 22 and the center cap 12 to support the center cap 12, so that the vibrating element including the center cap 12 can be increased in strength. This makes it possible to inhibit the deformation and the vibration of the center cap 12, resulting in an improvement in sound quality and inhabitation of abnormal sounds. A combination of this structure with the air-damper structure created by the hermetic space S makes it possible to provide a speaker much more improved in durability.

In the embodiment, the auxiliary cap 42 is mounted in such a manner as to be coupled to the center cap 12 for supporting the center cap 12. However, for example, the auxiliary cap 42 may be coupled and mounted to the diaphragm 11, and the form of the auxiliary cap 42 is not specially limited as long as the strength of the vibrating element 10 can be increased.

As described above, according to the embodiments of the present invention, the provision of a vibrating element 10 with a small phase difference makes it possible to reproduce sounds with high quality. Because the vibrating element 10 is shaped to cause divided vibrations not to easily occur, favorable frequency characteristics can be obtained. In addition, because the vibrating element 10 has a sufficient strength to withstand large-amplitude vibrations, it is possible to maintain high durability allowing for high power output.

While there has been described what are at present considered to be preferred embodiments of the present invention, it will be understood that various modifications may be made thereto, and it is intended that the appended claims cover all such modifications as fall within the true spirit and scope of the present invention.

The invention claimed is:

1. A speaker comprising:

a vibrating element;

a drive unit vibrating the vibrating element; and a frame supporting said vibrating element and said drive unit, wherein said vibrating element comprises a front face region and a connecting region connecting said front face region to said drive unit, said front face region has a convex-shaped cross-sectional portion and an annular concave-shaped cross-sectional portion arranged outside said convex-shaped cross-sectional portion, said convex-shaped cross-sectional portion and said concave-shaped cross-sectional portion form a continuously curved face, said front face region is supported by said connecting region at a position outside said concave-shaped cross-sectional portion, a part of said front face region supported by said connecting region forms said continuously curved face inclined in a direction toward said connecting region supporting said front face region from an outer periphery portion of said front face region, and a distance between said concave-shaped cross-sectional portion and said convex-shaped cross-sectional portion in a radial direction of said vibrating element is larger than a distance between said concave-shaped cross-sectional portion and said convex-shaped cross-sectional portion in a vibrating direction of said vibrating element.

2. The speaker according to claim 1, wherein said vibrating element has a diaphragm arranged outside the position where said connecting region supports said front face region, and a center cap arranged inside of said diaphragm, said diaphragm comprises a supporter supporting an outer peripheral rim of said center cap at the position where said connecting region supports said front face region, said supporter having a stepped stage, the outer peripheral rim of said center cap extends toward said driving unit from said supporter, and an end part of said connecting region in the side of said driving unit connects with a voice coil bobbin of said driving unit.

3. The speaker according to claim 2, wherein the convex-shaped cross-sectional portion in said center cap is provided either in approximately the same position as or in a position lower than the outer peripheral rim of said diaphragm.

4. The speaker according to claim 3, wherein the concave-shaped cross-sectional portion in said center cap is provided either in approximately the same position as or on the outside of the midpoint between the center of said front face region and the outer peripheral rim.

5. The speaker according to claim 4, wherein the concave-shaped cross-sectional portion in said center cap is provided in proximity to the outer peripheral rim of said connecting region.

6. The speaker according to claim 4, wherein said supporter supports the outer peripheral rim of said center cap to allow the outer peripheral portion of said front face region in said diaphragm and the front face of said center cap to form a seamlessly adjoined face.

7. The speaker according to claim 1, wherein a hole through which a flexible wire passes for electrical connection to a voice coil of said driving unit is formed through a side face in said connecting region, the concave-shaped cross-sectional portion of said front face region is provided either in approximately the same position as or in a position higher than the hole formed in said connecting region.

8. The speaker according to claim 7, wherein the convex-shaped cross-sectional portion of said front face region is provided either in approximately the same position as or in a position lower than the outer peripheral rim of said front face region.

9. The speaker according to claim 8, wherein the concave-shaped cross-sectional portion of said front face region is provided either in approximately the same position as or on the outside of the midpoint between the center of said front face region and the outer peripheral rim.

10. The speaker according to claim 1, wherein said vibrating element has a diaphragm forming an outer peripheral portion of said front face region and said connecting region, and a center cap forming a central portion of said front face region, said diaphragm comprises a supporter having a stepped stage provided on the boundary position between the outer peripheral portion of said front face region and said connecting region and extending in the rear direction of the speaker, said supporter supports the outer peripheral rim of said center cap, the concave-shaped cross-sectional portion in said center cap is provided either in approximately the same position as or in a position higher than a lower end of said supporter.

11. The speaker according to claim 10, wherein the convex-shaped cross-sectional portion in said center cap is provided either in approximately the same position as or in a position lower than the outer peripheral rim of said diaphragm.

12. The speaker according to claim 11, wherein said supporter supports the outer peripheral rim of said center cap to allow the outer peripheral portion of said front face region in said diaphragm and the front face of said center cap to form a seamlessly adjoined face.

13. The speaker according to claim 1, further comprising an auxiliary cap supporting said front face region.

14. The speaker according to claim 13, wherein said auxiliary cap is coupled to a voice coil bobbin through a coupling member.

15. The speaker according to claim 13, wherein said auxiliary cap supports the convex-shaped cross-sectional portion of said front face region.

16. The speaker according to claim 1, wherein said vibrating element comprises a diaphragm forming an outer peripheral portion of said front face region and said connecting region, a center cap forming a central portion of said front face region, an edge member connecting the outer peripheral rim of said diaphragm with said frame, and a damper member through which a voice coil bobbin of said driving unit is supported by said frame.

17. The speaker according to claim 1, wherein said vibrating element comprises a diaphragm forming an outer peripheral portion of said front face region, a center cap forming a central portion of said front face region, a drive cone supporting said diaphragm and forming said connecting region, and a second edge member connecting the outer peripheral rim of said drive cone with said frame.

18. The speaker according to claim 17, having a hermetic space enclosed with said edge member, said diaphragm, said drive cone, said second edge member and said frame, said driving unit having a voice coil, a voice coil bobbin and a magnetic circuit.

19. The speaker according to claim 1, wherein a plurality of concave and convex shapes including said convex-shaped cross-sectional portion and said concave-shaped cross-sectional portion are formed in said front face region.

* * * * *